US010179882B2

(12) United States Patent
Cagnon et al.

(10) Patent No.: US 10,179,882 B2
(45) Date of Patent: Jan. 15, 2019

(54) SYSTEM AND METHOD FOR INJECTING LIQUID ODORANT INTO A NATURAL GAS PIPELINE

(71) Applicant: ENGIE, Courbevoie (FR)

(72) Inventors: Francois Cagnon, Paris (FR); Mohamed Kameche, Epinay sur Seine (FR)

(73) Assignee: ENGIE, Courbevoie (FR)

( * ) Notice: Subject to any disclaimer, the term of this patent is extended or adjusted under 35 U.S.C. 154(b) by 0 days.

(21) Appl. No.: 14/897,284

(22) PCT Filed: Jun. 10, 2014

(86) PCT No.: PCT/FR2014/051398
§ 371 (c)(1),
(2) Date: Dec. 10, 2015

(87) PCT Pub. No.: WO2014/199069
PCT Pub. Date: Dec. 18, 2014

(65) Prior Publication Data

US 2016/0115407 A1 Apr. 28, 2016

(30) Foreign Application Priority Data

Jun. 10, 2013 (FR) ..... 13 55338

(51) Int. Cl.
*C10L 3/00* (2006.01)
*B01F 5/04* (2006.01)
(Continued)

(52) U.S. Cl.
CPC ..... *C10L 3/006* (2013.01); *B01F 3/04056* (2013.01); *B01F 5/0483* (2013.01);
(Continued)

(58) Field of Classification Search
CPC ..... Y10T 137/2499; Y10T 137/2501; Y10T 137/2529; Y10T 137/87652;
(Continued)

(56) References Cited

U.S. PATENT DOCUMENTS 3,219,046 A * 11/1965 Waugh ..... F16L 55/00 137/101.19
3,634,053 A * 1/1972 Klass ..... C10L 3/006 137/3
(Continued)

FOREIGN PATENT DOCUMENTS

UA 48696 C2 8/2002
WO 2008004089 A2 1/2008

OTHER PUBLICATIONS

International Search Report for corresponding International PCT Application No. PCT/FR2014/051398, dated Sep. 9, 2014.

*Primary Examiner* — Kevin Murphy
(74) *Attorney, Agent, or Firm* — Workman Nydegger

(57) ABSTRACT

The invention relates to a system and a method for injecting liquid odorant into a natural gas pipe, the system comprising: a tank containing the odorant in liquid form; a high-pressure pump connected to the tank; a common injection manifold fed with liquid odorant by the high-pressure pump; a plurality of odorant injectors fed with liquid odorant under pressure by the common injection manifold for the purpose of injecting the odorant into the gas pipe so as to cause it to be atomized in the gas pipe; and an electronic injection computer for controlling the injectors and the high-pressure pump.

20 Claims, 2 Drawing Sheets

(51) Int. Cl.

| | |
|---|---|
| ***B01F 15/00*** | (2006.01) |
| ***B05B 1/30*** | (2006.01) |
| ***B05B 12/04*** | (2006.01) |
| ***B05B 12/12*** | (2006.01) |
| ***B01F 3/04*** | (2006.01) |
| ***B05B 7/00*** | (2006.01) |

(52) U.S. Cl.
CPC ..... *B01F 5/0485* (2013.01); *B01F 15/00136* (2013.01); *B05B 1/3053* (2013.01); *B05B 7/0075* (2013.01); *B05B 12/04* (2013.01); *B05B 12/12* (2013.01); *C10L 2230/10* (2013.01); *C10L 2290/141* (2013.01); *C10L 2290/58* (2013.01); *F17C 2265/027* (2013.01); *Y10T 137/2501* (2015.04); *Y10T 137/2529* (2015.04)

(58) Field of Classification Search
CPC ..... Y10T 137/8766; Y10T 137/8729; Y10T 137/87298; C10L 3/006; C10L 2290/141; B01F 5/0471–5/0493
See application file for complete search history.

(56) References Cited

U.S. PATENT DOCUMENTS

| | | | | | |
|---|---|---|---|---|---|
| 3,907,515 | A * | 9/1975 | Mulliner | C10L 3/006 | 236/21 R |
| 3,913,617 | A * | 10/1975 | van Laar | B01F 5/0471 | 137/599.01 |
| 4,025,315 | A * | 5/1977 | Mazelli | B01F 3/08 | 261/DIG. 17 |
| 4,487,613 | A * | 12/1984 | Yoshida | C10L 3/006 | 116/214 |
| 5,213,586 | A * | 5/1993 | Welker | C10L 3/006 | 137/202 |
| 5,632,295 | A * | 5/1997 | Smårs | C10L 3/006 | 137/3 |
| 5,746,238 | A * | 5/1998 | Brady | B01F 3/088 | 137/101.19 |
| 7,779,864 | B2 * | 8/2010 | Mazzei | B01F 3/04503 | 137/599.03 |
| 8,091,575 | B2 * | 1/2012 | Gammon | G05D 11/132 | 137/100 |
| 8,349,038 | B2 * | 1/2013 | Zeck | F17D 3/12 | 137/101.19 |
| 2005/0155644 | A1 | 7/2005 | Woollums | | |

* cited by examiner

SYSTEM AND METHOD FOR INJECTING LIQUID ODORANT INTO A NATURAL GAS PIPELINE

BACKGROUND OF THE INVENTION

The present invention relates to the general field of odorizing natural gas, and more precisely it relates to a system and a method of injecting liquid odorant into a natural gas pipe.

Natural gas is odorless. Because of its potentially dangerous nature, present-day regulations require an odorant to be added in natural gas pipes in order to enable natural gas to be detected by means of its odor. This operation is generally performed using pure odorants or mixtures of odorants such as tetrahydrothiophene (designated by the acronym THT) or tert-butyl mercaptan (designated by the acronym TBM).

Systems for injecting odorant in liquid form into a natural gas pipe are generally dimensioned so as to be effective at the maximum observable gas flow rate at the point of injection. Nevertheless, when the real flow rate of gas becomes lower than the maximum flow rate, prior art systems for injecting odorant become less effective, which can lead to defective odorization of the gas.

Furthermore, such observed variations in the gas flow rate in pipes are particularly large when the maximum flow rate of gas to be odorized is small, as can occur in particular at points for injecting biomethane or at gas distribution stations. In addition, the opening up of gas markets to competition has led to ever increasing variability being observed in the amplitude and the frequency of the gas flow rates that can be observed, even at points for interconnecting large gas transport networks.

Various systems are known for odorizing natural gas. In particular there exist systems for injection by evaporation in which a portion of the gas for odorizing is diverted from the main flow and is put into contact with the liquid odorant, which it evaporates until thermodynamic equilibrium is reached. The diverted flow is then mixed with the main gas flow in order to obtain a mixture containing the desired odorant content.

Such evaporation systems require the supply of liquid odorant to be maintained at the same pressure as the gas flowing in the pipe, which can raise manifest problems with regulations. In addition, contact between the odorant and natural gas leads to the odorant being polluted, with it being possible for compounds in the gas to become dissolved in the odorant, thereby degrading its quality. Finally, the physical principle on which such systems are based leads to great variability in the contents of odorant in the gas if there is a change in ambient temperature (since saturated vapor pressure is a function of temperature). This physical principle is also very poorly adapted to using odorants that are made up of a mixture of chemicals, such as in particular TBM.

Another known system is that of systems using injection and a pump, in which liquid odorant is injected directly into the gas pipe by means of a diaphragm pump or by injecting odorant by means of gas under pressure. The liquid odorant evaporates in the gas by having recourse to an injection tube including a porous material, or after spraying coarse droplets.

Those injection and pump systems inject a fixed quantity of odorant each time the pump is activated. In particular, when the flow rate of gas in the pipe becomes very low, the frequency at which the pump is activated decreases, thereby leading to the system operating discontinuously. Unfortunately, the absence of back pressure between two successive actuations of the pump leads to the pump losing its priming if there is the slightest sealing defect in the pump. Furthermore, injecting a large quantity of odorant into a very low gas flow rate each time the pump is actuated leads to poor evaporation of the odorant.

OBJECT AND SUMMARY OF THE INVENTION

A main object of the present invention is thus to provide a system and a method of injecting liquid odorant into a natural gas pipe that does not present the above-mentioned drawbacks.

In accordance with the invention, this object is achieved by a system for injecting liquid odorant into a natural gas pipe, the system comprising: a tank containing the odorant in liquid form; a high-pressure pump connected to the tank; a common injection manifold fed with liquid odorant by the high-pressure pump; a plurality of odorant injectors fed with liquid odorant under pressure by the common injection manifold for the purpose of injecting the odorant into the gas pipe so as to cause it to be atomized in the gas pipe; and an electronic injection computer for controlling the injectors and the high-pressure pump.

The pressure in the common injection manifold is maintained at a high value by the high-pressure pump. The pressure at which the odorant is injected at the outlet from an injector can thus be high, thereby optimizing odorant/gas mixing in the gas pipe. More precisely, by reducing the outlet section of the injectors and by using a high pressure at the outlet from the injectors, it is possible to increase the speed at which the liquid odorant is injected into the gas pipe. The speed difference between the flow of the natural gas in the gas pipe and the injection speed of the odorant leads to almost instantaneous atomization of the odorant when it is injected (the continuous jet of liquid odorant transforms into a mist of odorant droplets having a diameter of the order of a few micrometers). This leads to optimizing odorant/gas mixing.

Furthermore, controlling the injectors by an electronic injection computer makes it possible to control accurately the quantities of odorant that are injected, in particular as a function of the gas flow rate in the gas pipe. Likewise, the range of gas flow rates that can be "odorized" can be increased by subdividing the flow rate at which odorant is injected by using a plurality of injectors.

The pressurizing of the liquid odorant (by the high-pressure pump) may be physically separated from regulating the quantities of odorant that are injected (via injectors), thereby avoiding any loss of priming of the high-pressure pump associated with sealing defects.

In addition, the injection system invention is relatively compact compared with prior art injection systems, thus enabling it to be installed directly on the gas pipe, and possibly enabling a plurality of systems to be installed in parallel for odorizing high gas flow rates.

Preferably, the system further comprises a sensor for measuring the gas flow rate, connected to the electronic injection computer, and serving to measure the flow rate of gas flowing in the natural gas pipe upstream from the injectors. The injection system is thus made completely independent of external flow rate measurement, thus increasing its reliability.

Also preferably, the common injection manifold includes a pressure limiter device. Such a device makes it possible to control pressure in the common injection manifold, thereby avoiding any excess pressure in the injectors, which could lead to faulty operation.

The injectors may be electrohydraulic injectors controlled by solenoid valve or controlled by piezoelectric actuator. The system may further include a filter interposed between the tank and the high-pressure pump.

The injectors may be fastened to a common sleeve for mounting in a gas pipe via flange mounting. This simplifies installing such a system on a gas pipe and does not require any particular civil engineering work. Furthermore, the sleeve with its injectors can be manufactured in full in a factory, thereby facilitating both qualification testing and maintenance operations.

The invention also provides a method of injecting liquid odorant into a natural gas pipe, the method comprising: using a high-pressure pump to feed a common injection manifold with liquid odorant coming from a tank, said common injection manifold being connected to a plurality of injectors leading into a gas pipe; and using an electronic injection computer to control the injectors to inject a predetermined volume of liquid odorant into the gas pipe at a predetermined pressure so as to cause the odorant to be atomized in the gas pipe.

The common injection manifold may be fed with liquid odorant at a pressure lying in the range 200 bars to 2000 bars, and the gas pipe may be fed with natural gas at a pressure lying in the range one bar to 100 bars.

BRIEF DESCRIPTION OF THE DRAWINGS

Other characteristics and advantages of the present invention appear from the following description made with reference to the accompanying drawings, which show an embodiment having no limiting character. In the figures.

DETAILED DESCRIPTION OF THE INVENTION

Figure 1:
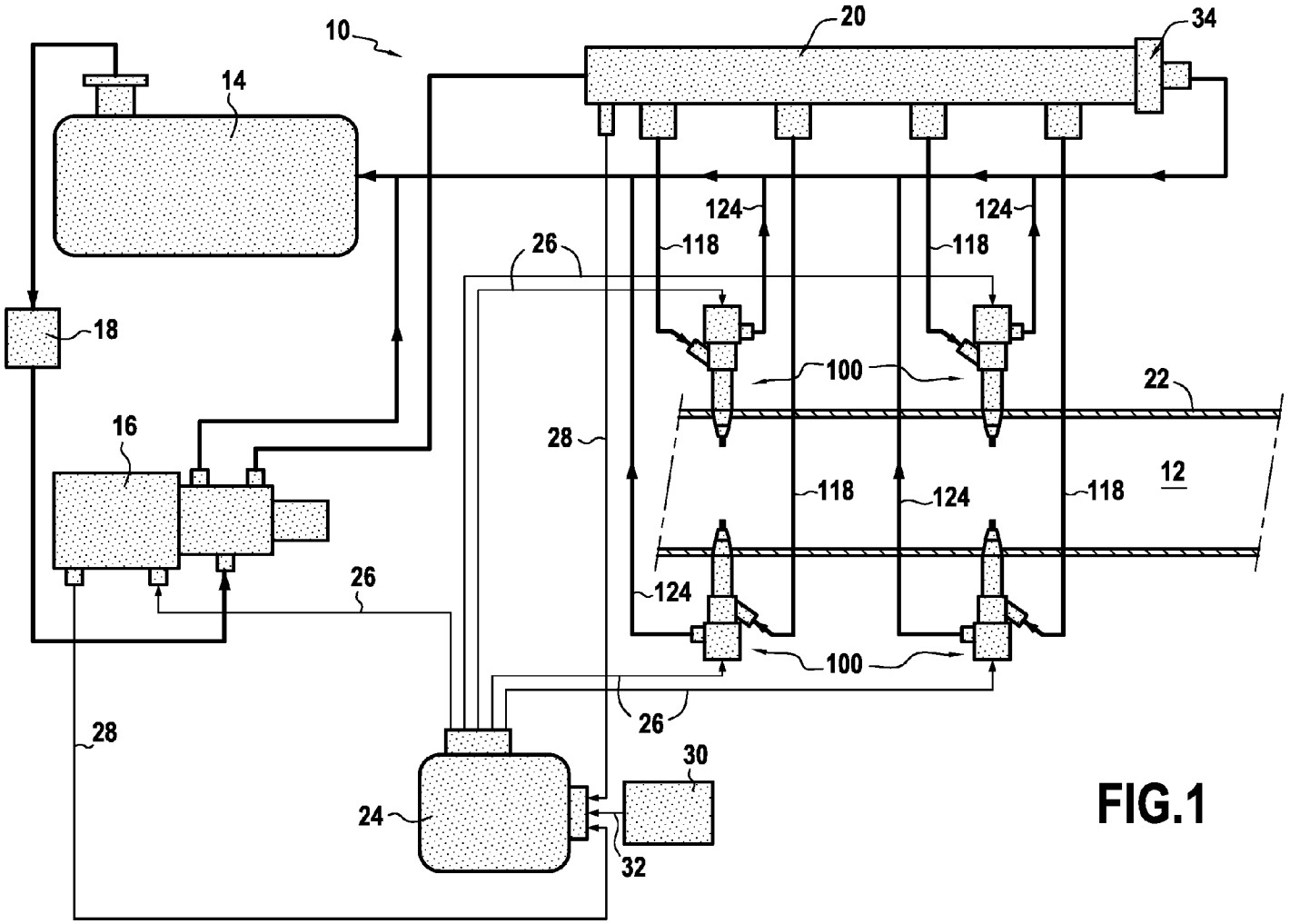
FIG. 1 is a diagrammatic view of an injection system of the invention.

FIG. 1 is a diagram showing an injection system 10 of the invention for injecting liquid odorant into a gas pipe 12.

The injection system 10 comprises in particular a tank 14 containing the odorant, which is present in liquid form. The liquid odorant is typically tetrahydrothiophene or thiophane (commonly designated by the acronym THT). Alternatively, it may be made up of tert-butyl mercaptan (designated by the acronym TBM) or of a mixture of these chemicals with each other or with other chemicals.

The tank 14 is connected to a high-pressure pump 16 with a filter 18 being interposed between these elements. The high-pressure pump is dimensioned so as to be capable of delivering the maximum needed flow rate at a pressure lying in the range 200 bars to 2000 bars, approximately.

The high-pressure pump 16 feeds a common injection manifold 20 continuously with liquid odorant under pressure. By way of example, this high-pressure pump 16 is a rotary pump known to the person skilled in the art.

The common injection manifold 20 is a hydraulic accumulator that constitutes a reserve of liquid odorant under high pressure. This manifold distributes the liquid odorant to a plurality of injectors 100 (there being four in this example) in uniform manner, i.e. the manifold feeds each of the injectors at the same pressure and with the same quantity of liquid odorant.

The injectors 100 serve to atomize the liquid odorant into the gas pipe 12 by the odorant vaporizing on coming into contact with the natural gas flowing in the gas pipe.

More precisely, the injectors 100 serve to inject a jet of liquid odorant into the gas pipe 12 that becomes transformed into an atomized spray, i.e. into a cloud of odorant droplets (having a diameter of the order of a few micrometers) thereby enhancing mixing of the odorant in the flow of natural gas.

More precisely, at the outlet from each injector, the jet of liquid odorant disintegrates immediately because of the very great difference in speed between the injected liquid and the natural gas flowing in the gas pipe (the odorant is said to be atomized).

Figure 2:
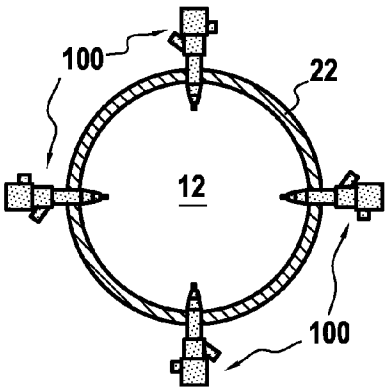
FIG. 2 is a fragmentary view of an injection system of the invention showing a sleeve having a plurality of injectors of the injection system fastened thereto.

As shown in FIG. 2, the injectors 100 may advantageously be fastened to a common sleeve 22 of the gas pipe, this sleeve being mounted directly on the gas pipe 12 (e.g. by flange mounting). In conventional manner, a sleeve is a tubular element that is interposed between two existing portions of pipe and that provides continuity in the transport of natural gas.

Furthermore, the injectors 100 may be regularly spaced apart angularly from one another over the entire circumference of the sleeve 22, so as to enable odorant to be injected as uniformly as possible.

An electronic injection computer 24 is electrically connected to the injectors 100 and to the high-pressure pump 16 in order to control them (via electrical connections 26 in FIG. 1). In particular, the electronic injection computer serves to control the quantity of odorant that is injected by each injector, and also the duration of injection.

For this purpose, the injectors 100 are electrohydraulic injectors controlled by solenoid valves or controlled by piezoelectric actuators, thereby enabling the duration of injection and the exact quantity of odorant to be injected to be controlled electronically.

Figure 3B:
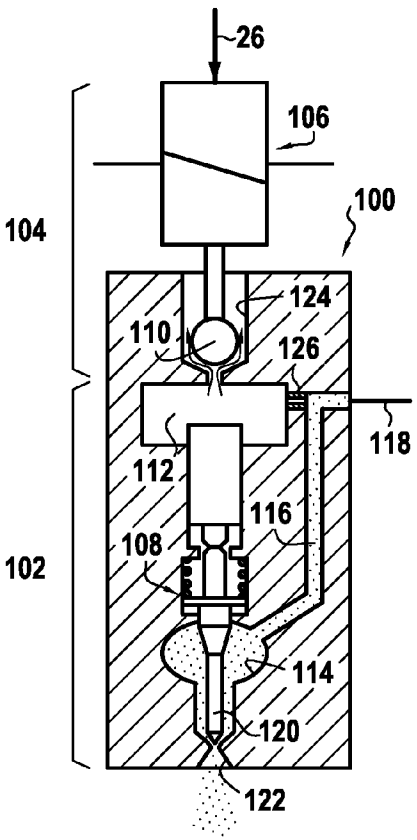
FIGS. 3A and 3B show the operation of an electrohydraulic injector suitable for use in the injection system of the invention.
Figure 3A:
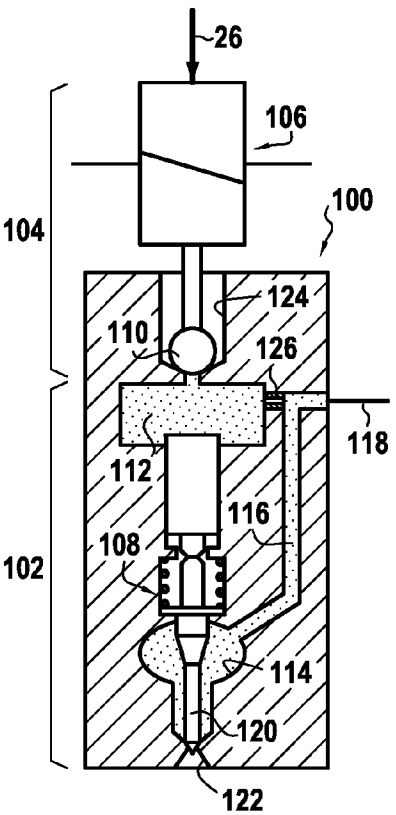

FIGS. 3A and 3B are diagrams showing the operation of an example of an electrohydraulic injector 100 of the type controlled by a solenoid valve and suitable for use in the invention.

In known manner, the injector 100 is made up of two portions, namely a bottom portion 102 that constitutes the injector proper (often referred to as the nozzle), and a top portion 104 that constitutes the electrical control device of the injector.

Such an injector operates as follows. At rest, the injector is in a closed position as shown in FIG. 3A. In this position, the solenoid valve 106 is not operated. The return spring 108 presses the ball 110 against its seat. The pressure in the control chamber 112 is equal to the pressure in the pressure chamber 114 that is fed with liquid odorant via channels 116 formed in the nozzle of the injector and connected upstream to the feed circuit 118 (itself connected to the common injection manifold). The return spring 108 holds the needle of injector 120 on its sealing bearing surface so as to close the injection hole(s) 122.

When the injector begins to open, the solenoid valve 106 is powered under the control of electrical pulses from the electronic injection computer 24. Its magnetic core compresses the return spring 108, which raises the ball 110 off its seat and thus allows leakage to take place towards the return circuit 124 (FIG. 3B), thereby enabling odorant to be returned to the tank 14. The bleed connection 126 into the feed circuit avoids any need to balance pressures, thereby having the effect of raising the needle of the injector 120 so as to uncover the injection hole(s) 122.

When the injector is closed, the solenoid valve 106 ceases to be activated, so the return spring 108 pushes the magnetic core and drives the ball 110 against its seat in order to close the leaks. Pressure between the control chamber 112 and the pressure chamber 114 becomes balanced once again. The return spring 108 pushes the needle against its sealing bearing surface so as to shut the injection hole(s) 122.

Thus, the injector 100 operates like a solenoid valve, opening and closing very quickly in order to inject into the gas pipe the exact quantity of odorant that is set by the electronic injection computer 24. In particular, the flow rate of odorant injected by each injector depends on the pressure in the common injection manifold 20, on the length of time the needle 120 of the injector is open, and on the diameter of the injection hole(s) 122.

At the outlet from the injectors 100, the odorant in liquid form presents a pressure lying in the range 200 bars to 2000 bars, while the natural gas typically flows in the gas pipe 12 at a pressure lying in the range one bar to 100 bars. This large pressure difference, together with a small diameter for the injection hole(s) 122 of the injectors (typically in the range 0.1 millimeters (mm) to 0.2 mm), leads to a large difference in speed between the flow of natural gas in the gas pipe and the injection flow of odorant leaving the injectors. This speed difference leads to the odorant being atomized almost instantaneously on being injected into the gas pipe.

It should be observed that the injectors may be controlled by a piezoelectric actuator instead of a solenoid valve. Such a piezoelectric actuator is typically made up of a plurality of layers of quartz having the property of deforming on receiving an electrical pulse coming from the electronic injection computer. This enables injectors to be controlled particularly fast.

In order to ensure accurate control over the flow rate of odorant injected into the gas pipe 12, the electronic injection computer 24 receives information about the operation of the high-pressure pump 16 and of the common injection manifold 20 via electrical connections 28.

Likewise, it is advantageous to make provision for a sensor 30 to measure the gas flow rate in the gas pipe 12 upstream from odorant injection. By way of example, the sensor 30 may be an orifice plate, well known to the person skilled in the art for measuring a gas flow rate.

Such a sensor 30 is electrically connected via a connection 32 to the electronic injection computer 16 in order to inform it in real time about the flow rate of gas flowing in the gas pipe upstream from the injectors 100. The electronic injection computer can thus control accurately the quantities of odorant that are injected as a function of the gas flow rate in the gas pipe, and can adjust these quantities, in particular if the flow rate drops.

In another advantageous provision, the common injection manifold 20 includes a pressure limiter device 34. The function of the pressure limiter device is to control the pressure in the common injection manifold and to return the excess flow of odorant to the tank 14 via a controlled leak (connected to the return circuit 124).

Figure 4:
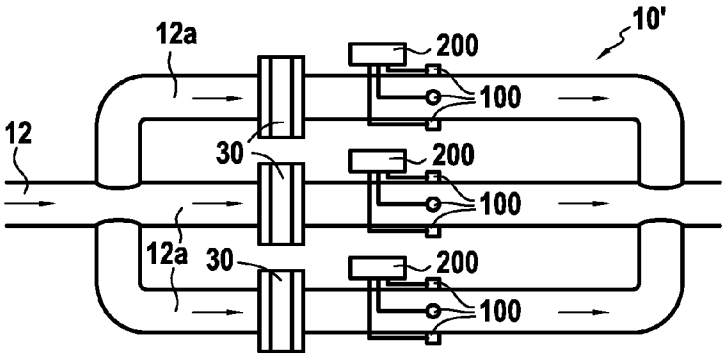
FIG. 4 is a diagrammatic view showing a variant embodiment of an injection system of the invention.

FIG. 4 shows an injection system 10' in a variant embodiment of the invention.

In this variant embodiment, the injection system 10' has a main gas pipe 12 that is split into a plurality of secondary pipes 12*a* (there being three of them in this example). Each secondary gas pipe 12*a* has its own liquid odorant injection module 200 (each module has a high-pressure pump, a common injection manifold, and an electronic injection computer, not shown in FIG. 4).

Each injection module 200 is connected to the same liquid odorant tank (not shown in figure) and to a plurality of injectors 100 leading into the corresponding secondary gas pipe. Upstream from the injectors, a sensor 30 is provided in each secondary gas pipe 12*a* for measuring the gas flow rate (e.g. an orifice plate).

Such a system makes it possible to enlarge the range over which odorization is effective by allowing natural gas to flow through and be odorized in a plurality of secondary gas pipes as a function of the flow rate of natural gas through the system. In addition, since the injection modules 200 are independent of one another, they can take over from one another, when necessary.

The invention claimed is:

1. A system for injecting liquid odorant into a natural gas pipe, the system comprising:

a tank containing the odorant in liquid form;

a high-pressure pump connected to the tank;

a common injection manifold fed with liquid odorant by the high-pressure pump;

a plurality of odorant injectors coupled directly to the gas pipe, wherein each of the odorant injectors is fed by the liquid odorant with a respective feed circuit under pressure by the common injection manifold, each of the feed circuits being connected to the common injection manifold such that each of the plurality of odorant injectors injects the odorant directly into the gas pipe and each of the plurality of odorant injectors causes the odorant to be atomized in the gas pipe; and an electronic injection computer that controls the injectors and the high-pressure pump and maintains a pressure difference between the odorant to be injected and the gas in the gas pipe such that an instantaneous atomization of the odorant is caused upon directly injecting the odorant into the gas pipe.

2. A system according to claim 1, further comprising a sensor for measuring the gas flow rate, connected to the electronic injection computer, and serving to measure the flow rate of gas flowing in the natural gas pipe upstream from the injectors.

3. A system according to claim 1, wherein the injectors are electrohydraulic injectors that are each controlled by a respective solenoid valve or are each controlled by a respective piezoelectric actuator.

4. A system according to claim 1, wherein the common injection manifold includes a pressure limiter device.

5. A system according to claim 1, further including a filter interposed between the tank and the high-pressure pump.

6. A system according to claim 1, wherein the injectors are fastened to a common sleeve for mounting in the gas pipe.

7. The system according to claim 1, wherein each of the odorant injectors extends within an internal diameter of the gas pipe.

8. The system according to claim 1, wherein the electronic injection computer controls the injectors and the high-pressure pump and maintains a speed difference between a flow of the gas in the gas pipe and an injection speed of the odorant to sustain the instantaneous atomization of the odorant upon being directly injected into the gas pipe.

9. The system according to claim 1, wherein each of the plurality of odorant injectors is configured to atomize the liquid odorant into the gas pipe by the odorant vaporizing on coming into contact with the natural gas flowing in the gas pipe.

10. The system according to claim 1, wherein each of the plurality of odorant injectors is configured to cause a continuous jet of liquid odorant to transform into a mist of odorant droplets having a diameter between 1 and 10 micrometers.

11. The system according to claim 1, wherein at least two or more of the plurality of odorant injectors are regularly spaced apart angularly from one another over a circumference of the gas pipe such that the odorant is injected uniformly into the gas pipe.

12. The system according to claim 1, wherein the liquid odorant is provided in liquid form at a pressure in the range 200 bars to 2000 bars, and the natural gas flows in the gas pipe at a pressure in the range of one bar to 100 bars.

13. The system according to claim 12, each of the odorant injectors includes an injection hole through which the liquid odorant is injected into the gas pipe, and a diameter of each of the injection holes is within a range of 0.1 mm to 0.2 mm.

14. The system according to claim 1, wherein each of the odorant injectors includes an injection hole through which the liquid odorant is injected into the gas pipe, and a diameter of each of the injection holes is within a range of 0.1 mm to 0.2 mm.

15. A method of injecting liquid odorant into a natural gas pipe, the method comprising:

using a high-pressure pump to feed a common injection manifold with liquid odorant coming from a tank, said common injection manifold being connected to a plurality of odorant injectors coupled directly to a gas pipe;

feeding each of the odorant injectors with the liquid odorant with a respective feed circuit under pressure by the common injection manifold, each of the feed circuits being connected to the common injection manifold;

injecting the odorant, by each of the plurality of odorant injectors, directly into the gas pipe, wherein each of the plurality of odorant injectors causes the odorant to be atomized in the gas pipe; and controlling the injectors and the high-pressure pump using an electronic injection computer and maintaining a pressure difference between the odorant to be injected and the gas in the gas pipe such that an instantaneous atomization of the odorant is caused upon directly injecting the odorant into the gas pipe.

16. A method according to claim 15, wherein the common injection manifold is fed with liquid odorant at a pressure lying in the range 200 bars to 2000 bars, and the gas pipe is fed with natural gas at a pressure lying in the range of one bar to 100 bars.

17. A method according to claim 15, wherein the odorant is tetrahydrothiophene.

18. The method according to claim 15, wherein each of the odorant injectors extends within an internal diameter of the gas pipe.

19. The method according to claim 15, further comprising controlling the injectors and the high-pressure pump with the electronic injection computer and maintaining a speed difference between a flow of the gas in the gas pipe and an injection speed of the odorant such that the instantaneous atomization of the odorant is sustained upon directly injecting the odorant into the gas pipe.

20. The method according to claim 15, wherein each of the plurality of odorant injectors is configured to atomize the liquid odorant into the gas pipe by the odorant vaporizing on coming into contact with the natural gas flowing in the gas pipe.

* * * * *